US007094071B2

(12) United States Patent
Hackemack et al.

(10) Patent No.: US 7,094,071 B2
(45) Date of Patent: Aug. 22, 2006

(54) JUNCTION BOX INCLUDING CONNECTOR DEFORMATION MEANS

(75) Inventors: Frank Hackemack, Detmold (DE); Werner Radde, Babenhausen (DE)

(73) Assignee: Weidmüller Interface GmbH & Co. KG, Detmold (DE)

( * ) Notice: Subject to any disclaimer, the term of this patent is extended or adjusted under 35 U.S.C. 154(b) by 0 days.

(21) Appl. No.: 10/953,464

(22) Filed: Sep. 30, 2004

(65) Prior Publication Data

US 2005/0085107 A1 Apr. 21, 2005

(30) Foreign Application Priority Data

Oct. 16, 2003 (DE) ..... 203 15 898 U

(51) Int. Cl.
*H01R 12/00* (2006.01)
*H01R 4/28* (2006.01)
*H05K 1/00* (2006.01)

(52) U.S. Cl. ..... 439/76.1; 439/761

(58) Field of Classification Search ..... 439/725, 439/724, 712, 814, 761, 76.1, 106, 107
See application file for complete search history.

(56) References Cited

U.S. PATENT DOCUMENTS

| | | | | |
|---|---|---|---|---|
| 3,775,733 | A | 11/1973 | Ege | |
| 3,890,029 | A * | 6/1975 | Izraeli | 439/397 |
| 4,674,819 | A * | 6/1987 | Fujitani et al. | 439/404 |
| 5,961,342 | A * | 10/1999 | Daoud | 439/403 |
| 6,074,238 | A | 6/2000 | DeRoss et al. | |

FOREIGN PATENT DOCUMENTS

| | | |
|---|---|---|
| DE | 100 01 667 C1 | 10/2001 |
| DE | 699 02 941 T2 | 5/2003 |
| DE | 1020160913 A1 | 5/2003 |
| GB | 2 212 008 A | 7/1989 |

* cited by examiner

*Primary Examiner*—Chandrika Prasad
(74) *Attorney, Agent, or Firm*—Lawrence E. Laubscher, Sr.; Lawrence E. Laubscher, Jr.

(57) ABSTRACT

A junction box containing at least one electrical terminal is connected for displacement between unfastened and fastened positions relative to a carrier element, whereby during movement of the housing toward the fastened position, a U-shape contact spring is progressively displaced on a contact tab portion of the terminal within the junction box from a retracted position to a clamping position, thereby to bend a deformable relatively small thin conductor into contiguous lateral engagement with the contact tab portion.

16 Claims, 8 Drawing Sheets

JUNCTION BOX INCLUDING CONNECTOR DEFORMATION MEANS

BACKGROUND OF THE INVENTION

1. Field of the Invention

A junction box containing an electrical terminal is mounted for displacement on a carrier element from an unfastened position to a fastened position, thereby to operate a clamping spring to deform and clamp a deformable conductor into lateral contiguous engagement with a tab portion of the terminal.

2. Description of the Related Art

There is a need in the electrical connector art to provide a connecting terminal that is simple in terms of design and that can be mounted in a particularly easy manner upon a carrier element and which is operable to connect a first thin conductor with an additional conductor having a diameter that is considerably larger than that of the first conductor, especially a conductor having a diameter that is a multiple of the smaller first diameter. In particular, it should be possible in a simple manner to connect a data line having a diameter of less than 1 mm, in particular, less than 0.5 mm, with a conductor having a multiple diameter of, for example, more than 1 or 2 mm.

BRIEF SUMMARY OF THE INVENTION

Accordingly, a primary object of the present invention is to provide a junction box that is mounted for displacement from an unfastened position to a fastened position relative to a carrier element, thereby to simultaneously displace a clamping spring from a retracted position to a clamping position, whereby a thin conductor is deformed and clamped to the contact tab portion of a terminal contained within the junction box housing.

According to a more specific object of the invention, the contact tab portion contains an opening through which the thin bare conductor is inserted, whereby movement of the clamping spring toward the clamping position causes the wire to be deformed into contiguous engagement and electrical contact with both sides of the contact tab. The contact tab is formed on a bus bar having a leg portion provided with a screw-operated fastening clamp by means of which a second conductor of larger diameter may be electrically connected in a positive rigid manner with the thin deformable conductor. The bus bar preferably has a U-shaped configuration, thereby defining a transverse portion provided with a female contact that permits the connection of a third large conductor with the small thin conductor. The additional conductors, for instance, can involve a very thin data line upon the carrier element, which is inserted into the passage hole only during assembly. Thereupon, the housing is mounted upon the carrier element and is engaged there, whereby the tension spring firmly clamps the thin data line upon the carrier element. Into the additional connection device, one can then introduce a conductor with a considerably larger diameter—for example, from a residential or commercial wiring installation. It is thus not only possible in a simple manner to contact the very thin conductor as such without any problems, but it is possible in the simplest way also to connect the very thin conductor with a definitely thicker conductor.

According to an advantageous feature of the invention, the U-shaped clamping spring is made in the shape of a tulip, which clamping spring is displaced on the contact tab toward the clamping position by means of a stationary abutment shoulder provided on the carrier element. During the displacement of the junction block toward the fastened position relative to the carrier element, the abutment shoulder extends within a guide groove contained within the housing of the junction box.

The structure of the connecting terminal features a simple design and assembly is possible without special tools in the manner of mounting the housing on the carrier element in an automated fashion in a simple manner.

In a particularly preferred manner, the junction box housing, in a rather inexpensive manner, has a sectional construction with an upper housing part and a lower housing part that can be engaged in interlocking relation. In a practical manner, the upper part of the housing on its side facing toward the lower part of the housing is made open and displays at least one or several partitions which subdivide the space in the lower part of the housing into a corresponding number of chambers depending on the number of connecting devices—for example, 2, 3 or more—of a particular design. One of the connecting devices is inserted here in each of the chambers as a transit connection. Both the number of the chambers and the number of the connecting devices can thus be varied to make widely differing connections in a simple fashion.

Advantageously, the bus bar is formed in a U-shaped manner in its upper area where one of the two longitudinal legs of the U engages the screw-operated clamping clip and where, adjoining the other of the two longitudinal legs, is provided an orthogonally arranged contact tab containing a connecting opening for receiving the thin conductor.

It is also possible in an inexpensive manner to connect one additional contact each, especially a tulip contact, with the basic leg of the U-shaped bus bar in an integral manner—especially by way of the punch/bending technique.

Preferably, the housing contains a first insertion opening opposite the bus bar contact tab portion, thereby to permit the insertion of the thin deformable conductor into the opening contained in the contact tab portion. A second opening is provided in the housing opposite the screw-operated clamping device, thereby to permit the insertion of the larger diameter second conductor. A third opening is provided in the housing opposite a female terminal provide on the transverse portion of the U-shaped bus bar.

For the firm attachment and fixation of the housing upon the carrier element, there are furthermore provided pivot projection means that project into undercut recesses contained in the carrier element, whereby there is a rear grasping action on the opposite side of the housing by means of a catch hook on the carrier element that is caught on the housing when the housing after the nose has been pushed in swings up into the undercuts upon the carrier element.

BRIEF DESCRIPTION OF THE DRAWINGS

Other objects and advantages of the invention will become apparent from a study of the following specification when viewed in the light of the accompanying drawings, in which.

DETAILED DESCRIPTION OF THE INVENTION

Figure 1A:
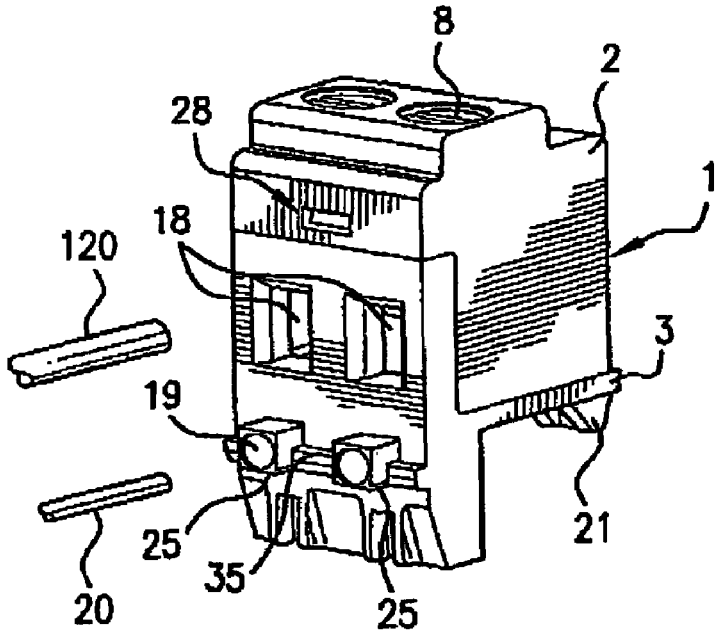
FIGS. 1*a*, 1*b*, and 1*c* are front perspective, rear perspective, and exploded views, respectively, of the junction box assembly of the present invention.
Figure 1B:
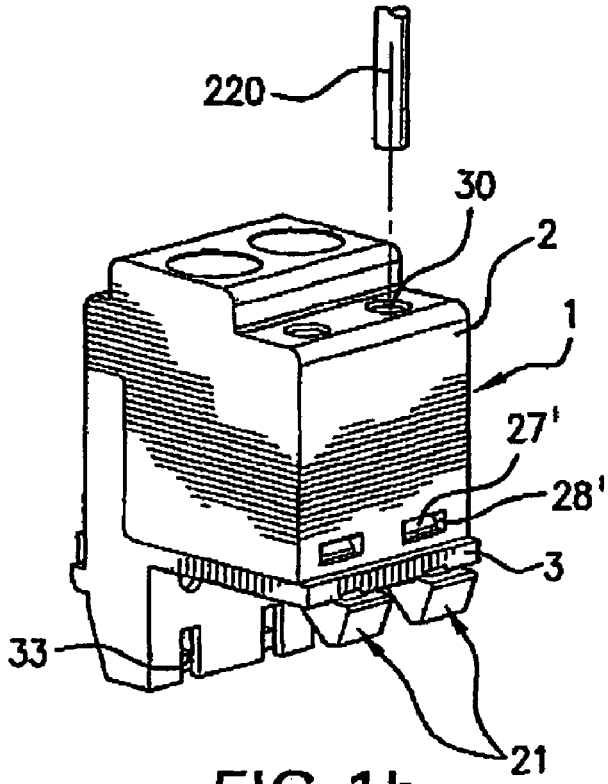
Figure 1C:
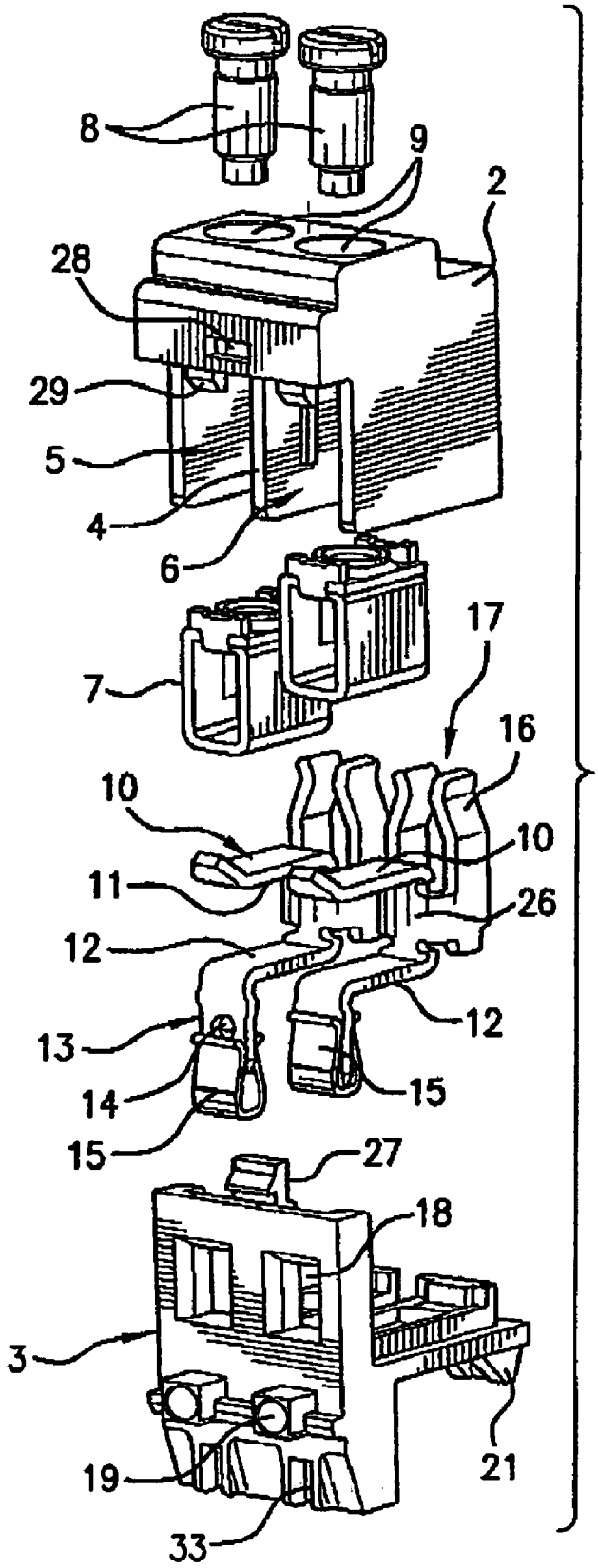
Figure 3A:
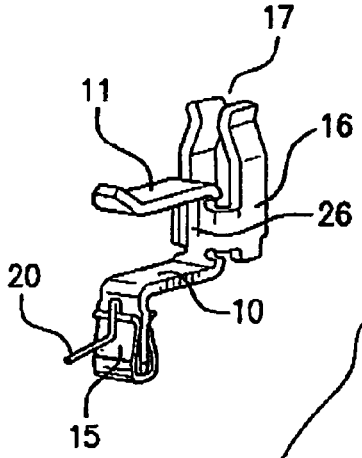
FIG. 3*a* is a front perspective view of one of the bus bars of the terminal means of FIG. 2*a*.
Figure 3B:
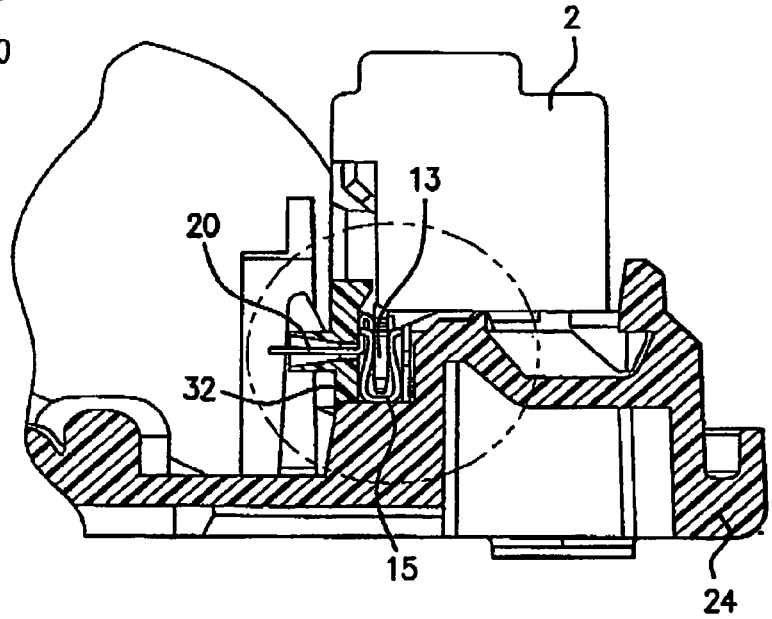
FIG. 3*b* is a side view of the junction box housing mounted on the carrier element.
Figure 3C:
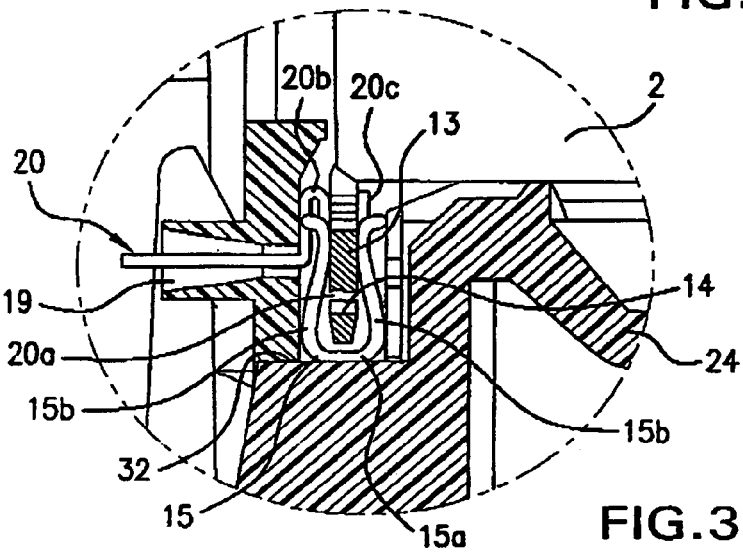
FIG. 3*c* is a detailed view of the terminal connection illustrated in FIG. 3*b.;*
Figure 4A:
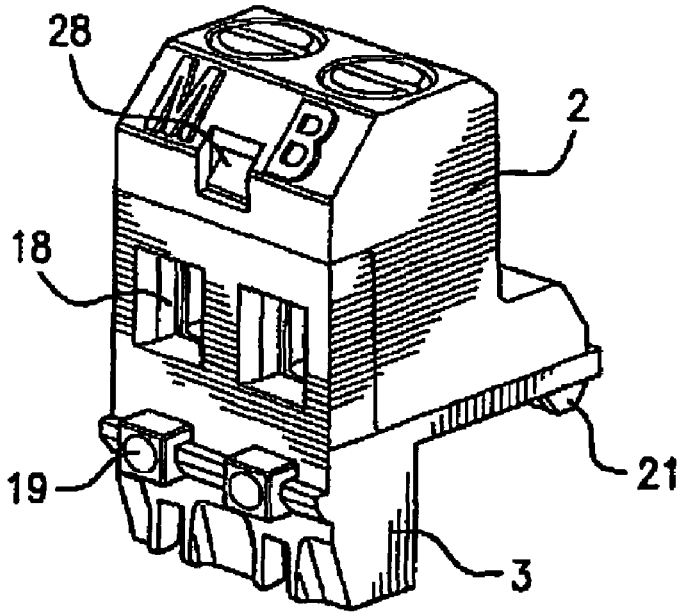
FIGS. 4*a*, 4*b*, and 4*c* are front perspective views, rear perspective views, and exploded views, respectively, of a second embodiment of the invention.
Figure 4B:
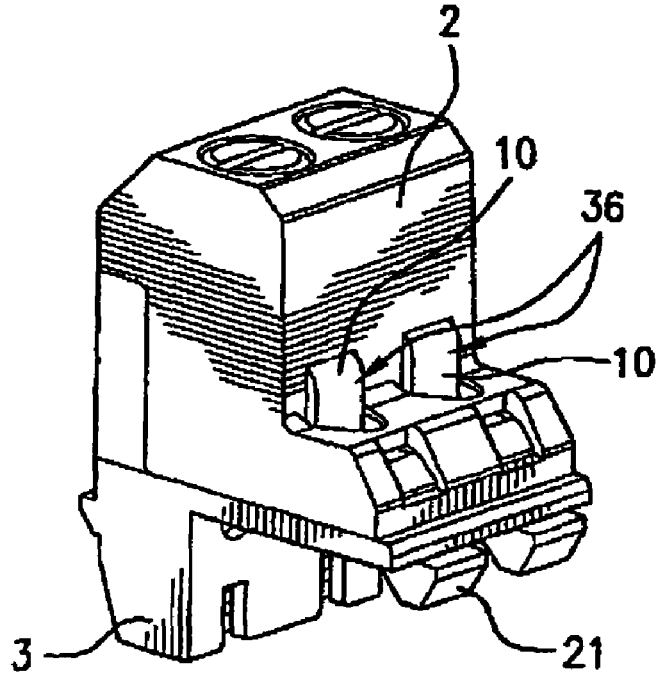
Figure 4C:
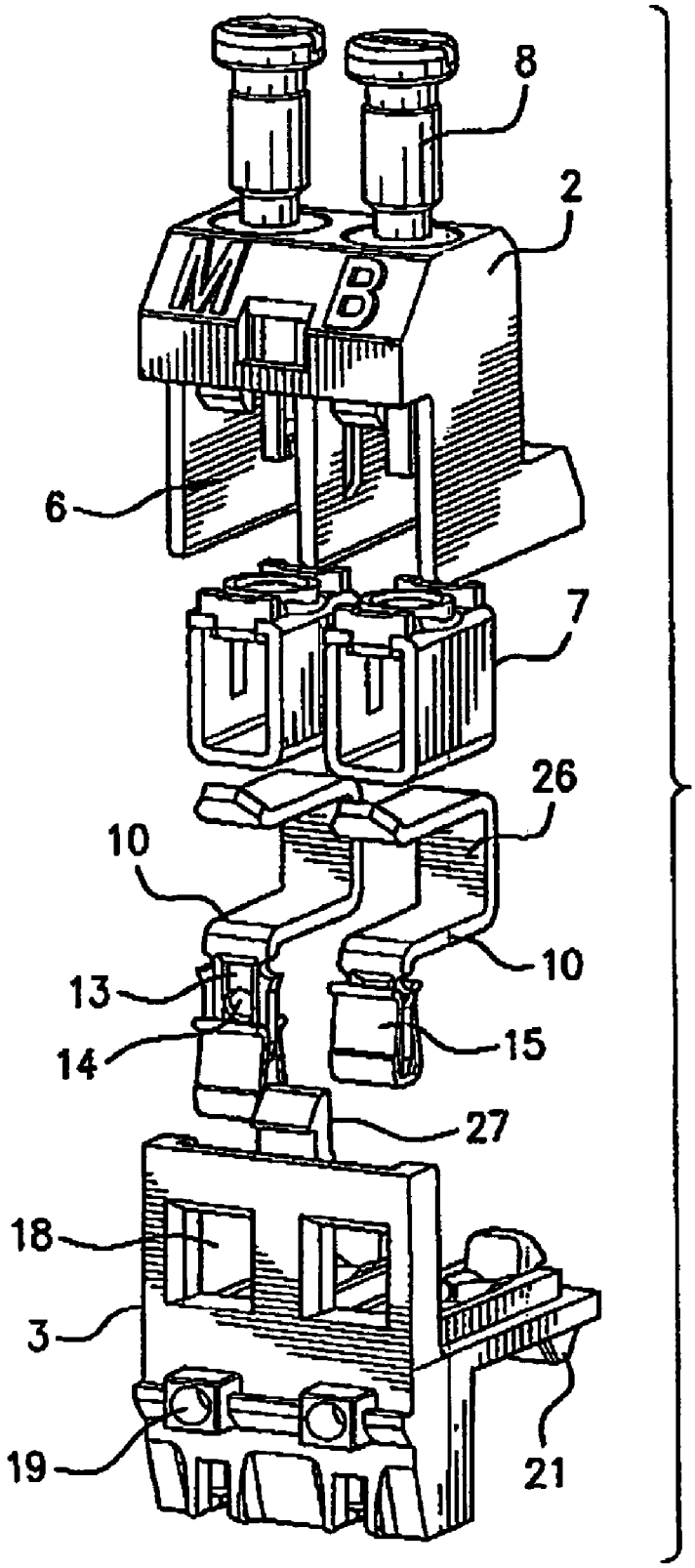

Referring more particularly to FIGS. 1*a*–1*c*, the junction box assembly 1 of the present invention includes an upper section 2 and a lower section 3 that are interlocked together. The upper section 2 contains a bottom chamber that is divided by transverse wall 4 into a pair of chambers 5 and 6 that are adapted to receive a pair of bus bars 10, respectively. Each bus bar has a generally U-shaped configuration and includes a pair of parallel leg portions 11 and 12 that are connected by a transverse portion 26. The extremity of the leg portion 12 is provided with an orthogonally arranged contact tab portion 13 that contains an opening 14. In accordance with a characterizing feature of the invention, there is provided on the tab portion 13 of each bus bar 10 a resilient U-shaped spring member 15 that is slidably displaceable between released and clamping positions respectively. As best shown in FIG. 3*c*, the U-shaped spring 15 has a horizontal transverse portion 15*a*, and a pair of upwardly extending leg portions 15*b* and 15*c*. The upper free ends of the leg portions flare outwardly, thereby giving the spring 15*a* a generally tulip-shaped cross-sectional configuration. Arranged on the transverse portions 26 of the bus bars are female contacts 17 having leg portions 16.

Figure 2A:
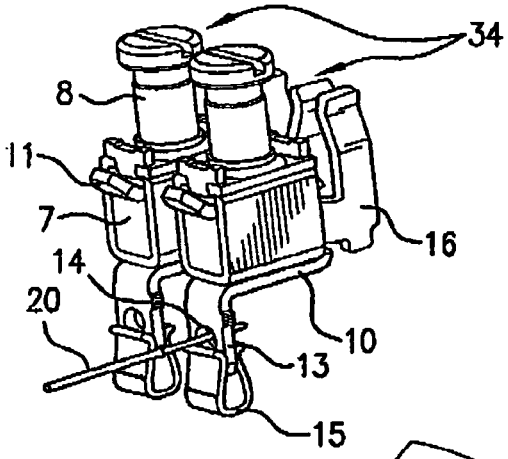
FIG. 2*a* is a detailed perspective view of the terminal means of the junction box assembly of FIG. 1*a*.

The front of the lower housing section 3 contains a pair of front openings 19 That receive relatively small deformable conductors 20 that extend within the openings 14 contained in the contact tab portions 13 of the bus bars 10, as will be described in greater detail below. The lower housing section 3 also contains a pair of larger openings 18 that receive conductors 120 of larger diameter that extend within openings contained in clamping clip members 7 that are mounted on the upper leg portions 11 of the bus bars 10, as best shown in FIG. 2*a*. Tensioning screw means 8 extend through a pair of openings 9 contained in the upper portion of the upper housing section 2 for engagement with the corresponding threaded openings contained in the clip members 7, as is known in the art. Thus, when a tension screw is rotated to draw the clip member 7 in an upwardly extending direction, the associated conductor 120 is biased into electrical engagement with the lower surface of the upper leg 11 of the corresponding bus bar 10. Finally, a pair of third conductors 220 may be inserted through openings 30 contained in the upper portion of the upper section 2 for engagement with the female contacts 17 on the transverse portions 26 of the bus bars 10, respectively. The lower housing section 3 is provided with a catch member 27 (FIG. 1*c*) that is adapted to extend within a corresponding opening 28 contained in the front wall of the upper housing section 2, thereby to fasten the housing sections in interlocking relation. Similar openings 28' (FIG. 1*b*) are provided In the rear wall of the upper housing member 2 for receiving rear catch members 27' on the lower housing member 3.

Figure 2B:
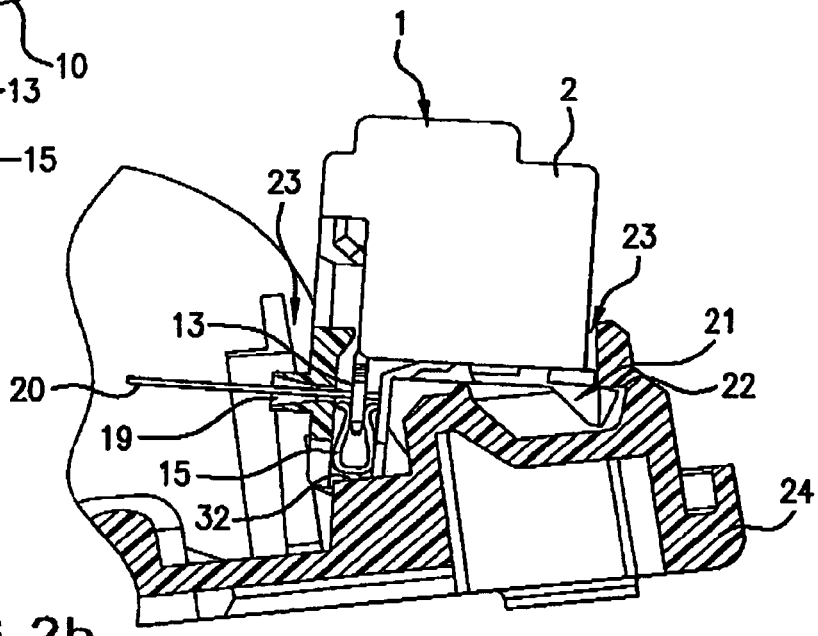
FIG. 2*b* is a detailed view indicating the procedure for mounting the junction box upon a carrier element.
Figure 2C:
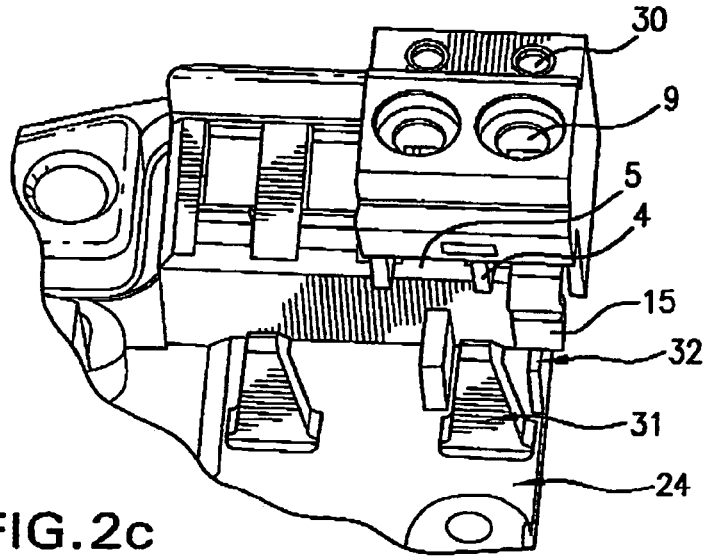
FIG. 2*c* is a detailed rear perspective view of the apparatus of FIG. 2*b;*

Referring now to FIGS. 2*a* and 2*b*, in order to connect a relatively small deformable conductor 20 with a bus bar 10 contained within the housing 1, the conductor 20 is inserted through the front opening 19 contained in the lower housing section 3, which conductor extends within an opening 14 contained within the tab portion 13 of the bus bar 10. As best shown in FIG. 2*b*, pivot projections 21 extending rearwardly from the rear portion of the lower housing section 3 extend within corresponding recesses 22 contained in a carrier element 24. In accordance with a characterizing feature of the present invention, as the housing 1 is pivoted downwardly about the pivot axis defined between the pivot projections 21 and the recesses 22, the transverse portion 15*a* of the contact spring 15 engages a stationery upwardly extending shoulder portion 32 on the carrier element 24, whereupon the spring 15 is displaced upwardly relative to the tab portion 13, thereby to deform the conductor into the clamping condition of FIG. 3*c*. More particularly, the spring leg portions 15*b* and 15*c* deform the conductor portions 20*b* and 20*c* upwardly relative to the conductor portion 20*a* within the tab opening 14, whereupon portions of the conductor 20 are clamped by spring 15 in contiguous engagement with opposed lateral surfaces of the tab portion 13. Thus, the conductor 20 is maintained in rigid electrical connection with the tab portion 13 of the bus bar 10. Similarly, the conductors 120 may be inserted through the openings 18 for connection with the upper legs 11 of the bus bars 10 by means of the clip members 7 as operated by the clamping screws 8, and the conductors 220 may be inserted through the housing openings 30 for connection with the resilient terminal means 17 connected with the transverse wall 26 of the bus bars 10. The bottom edge portion of the lower housing section 3 contains a plurality of guide slots 33 (FIG. 1*c*) that receive the support shoulders 32 of FIG. 2*c* when the housing member 1 is pivoted toward its fastened position on the carrier element 24.

Referring now to the embodiment of FIGS. 4*a*–6*c*, the major difference between this embodiment and the prior embodiment is the omission of the resilient contacts 17 on the rear surfaces of the transverse portions 26 of the bus bars 10. As shown in FIG. 4*b*, the rear portion of the upper housing section 2 contains openings 36 that provide access for test probes for engaging the rear surfaces of the bus bars 10.

Figure 5A:
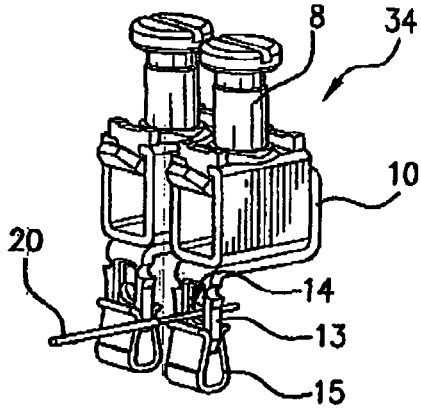
FIG. 5*a* is a front perspective view of the terminal means of FIG. 4*a*.
Figure 5B:
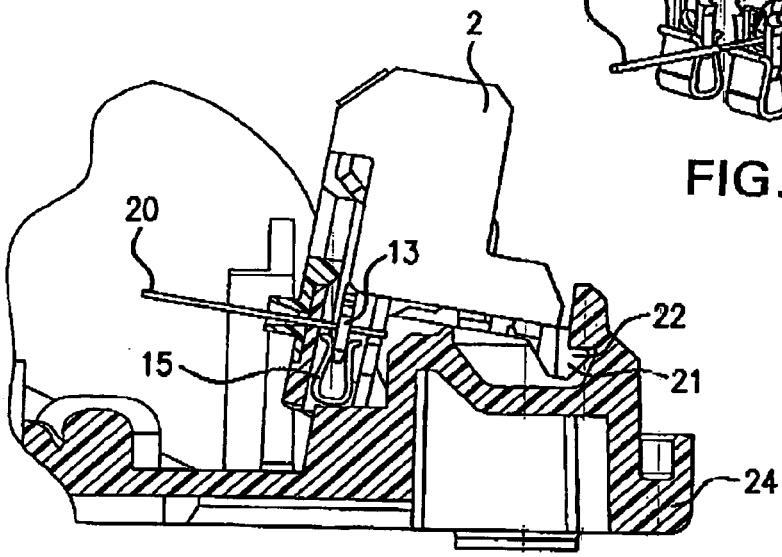
FIG. 5*b* is a detailed side view illustrating the manner of mounting the junction box upon a carrier element.
Figure 5C:
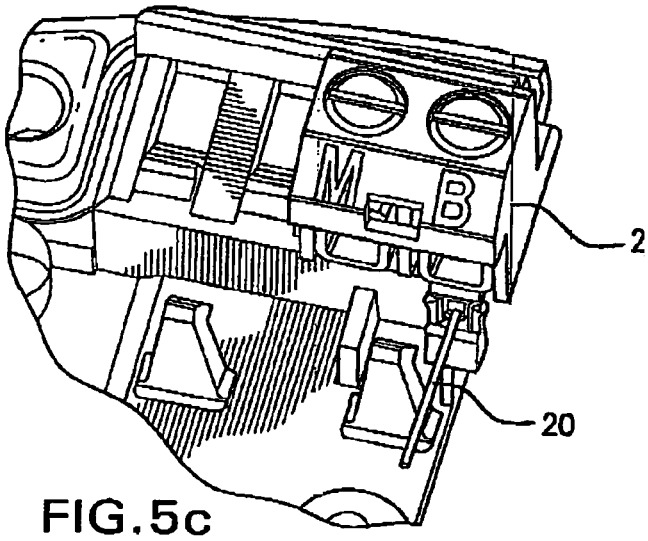
FIG. 5*c* is a detailed rear perspective view of the mounting means of FIG. 5*b;*
Figure 6A:
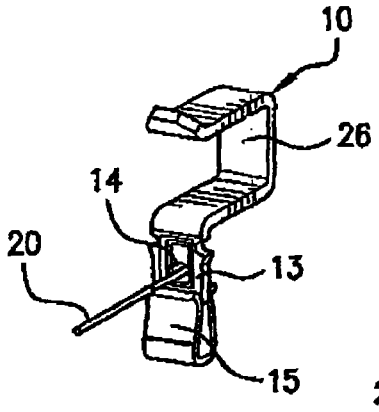
FIGS. 6*a* and 6*b* are front perspective views illustrating the manner of bending of the deformable small conductor by the resilient spring.
Figure 6B:
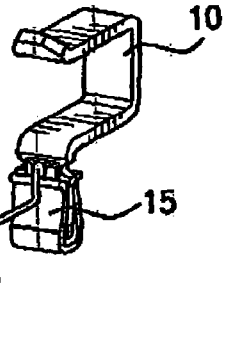
Figure 6C:
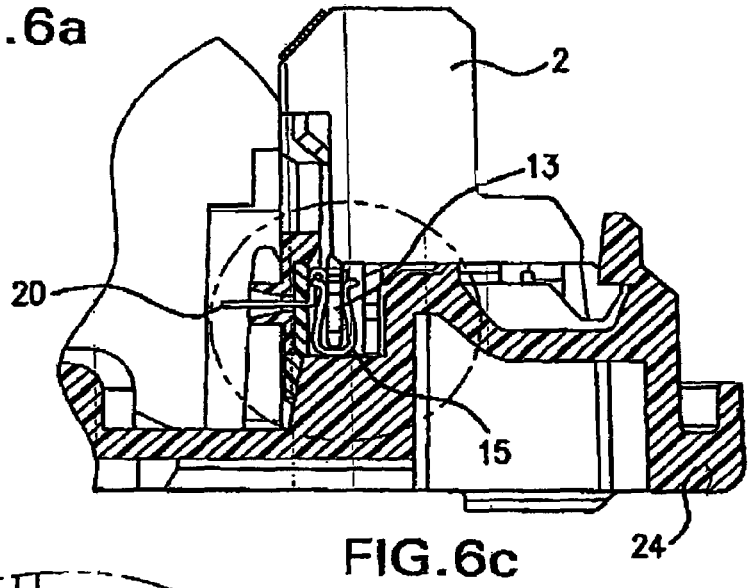
FIG. 6*c* illustrates the manner of assembly of the terminal means of FIG. 6*b*.
Figure 6D:
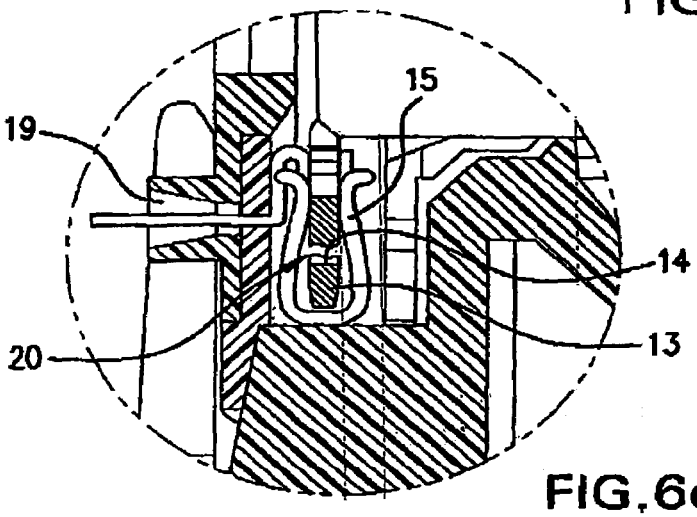
FIG. 6*d* is a detailed view of the connection of the terminal to the conductor illustrated in FIGS. 6*c*.

As before, during pivotal movement of the housing 1 about the pivot axis defined by the pivot projection 21 and the recess 22 of FIG. 5*b*, the conductor 20 is deformed by the displacement of spring 15 into engagement with the opposite lateral surfaces of the contact tab portion 13. Thus, as shown in FIG. 6*d*, the conductor 20 is deformed by spring 15 into engagement with opposed lateral surfaces of the electrical tab portion 13.

The invention is particularly suitable for connecting very thin deformable relatively delicate conductors 20 with the tab portion 13 of the bus bar 10 in a very positive rigidly supported manner. The conductor 20 has a diameter on the order of 0.3 mm.

While in accordance with the provisions of the Patent Statutes the preferred forms and embodiments of the invention have been illustrated and described, it will be apparent to those skilled in the art that various changes may be made without deviating from the inventive concepts set forth above.

What is claimed is:

1. A junction box adapted for mounting on a carrier element so as to connect one end of a deformable small first conductor with a terminal, comprising:

(a) a carrier element (24);

(b) a junction box housing (2) displaceable between unfastened and fastened positions relative to said carrier element, said housing containing at least one chamber (5, 6) adjacent said carrier element;

(c) terminal means (34) arranged in said chamber, said terminal means including a bus bar (10) having a contact tab portion (13) extending generally in the direction of said carrier element, said contact tab portion containing a conductor opening (14) for receiving the conductor end; and (d) means for deforming the conductor end into electrical engagement with sad bus bar contact tab portion, including a clamping spring (15) mounted on said bus bar tab portion for displacement from a first released position toward a second clamping position relative to said tab portion when said housing is displaced from the unfastened position to the fastened position relative to said carrier element, thereby to deform and clamp portions of said conductor into contiguous lateral engagement with said contact tab portion.

2. A junction box as defined in claim 1, and further including second terminal means for connecting to said bus bar a second conductor having a diameter that is larger than that of the first conductor.

3. A junction box as defined in claim 2, wherein said second terminal means includes a clamping clip (7) having an opening for receiving said bus bar and the second conductor, and a fastening screw (8) for fastening the second conductor in said clamping clip opening in engagement with said bus bar.

4. A junction box as defined in claim 1, wherein said clamping spring has a generally U-shaped configuration including a transverse portion (15*a*) and a pair of leg portions (15*b*, 15*c*) extending on opposite sides of said bus bar contact tab portion in the direction of said conductor opening, said spring leg portions being operable to deform and clamp corresponding portions of the conductor (20*b*, 20*c*) into engagement with said bus bar tab portion.

5. A junction box as defined in claim 4, wherein said carrier member includes stationary shoulder means (32) operable to displace said clamping spring from said released position toward said clamping position when said housing is displaced from said unfastened position to said fastened position, respectively.

6. A junction box as defined in claim 5, wherein said housing contains a guide slot (33) arranged to receive said shoulder means when said housing is displaced from said unfastened position to said fastened position.

7. A junction box as defined in claim 1, wherein said housing includes a pair of upper (2) and lower (3) sections, and means (27, 28; 27', 28') interlocking said sections.

8. A junction box as defined in claim 7, wherein said upper housing section contains said chamber, and at least one partition wall (4) dividing said chamber into a plurality of smaller chambers (5, 6).

9. A junction box as defined in claim 8, wherein a plurality of said terminal means are arranged in said chambers, respectively.

10. A junction box as defined in claim 2, wherein said terminal bus bar (10) is generally U-shaped and includes a pair of leg portions (11) connected by a transverse portion (26), said contact tab portion (13) extending normal to and outwardly from the extremity of one of said leg portions.

11. A junction box as defined in claim 10, and further including U-shaped resilient female third terminal means (17) connected with said bus bar transverse portion.

12. A junction box as defined in claim 11, wherein said housing contains first (19) and second (18) openings opposite said contact opening and said second terminal means, respectively, thereby to permit the insertion of said first and second conductors into said chamber, respectively.

13. A junction box as defined in claim 12, wherein said housing contains a third opening (30) opposite said third terminal means, thereby to permit the insertion of a third conductor into said chamber for connection with said second third terminal means.

14. A junction box as defined in claim 1, wherein said housing contains at least one outwardly extending pivot projection (21) operable to engage a corresponding recess (22) contained in said carrier element, thereby to define a pivot axis about which said housing pivots during displacement from said unfastened position to said fastened position relative to said carrier element.

15. A junction box as defined in claim 14, and further including catch means (31) for locking said housing in said fastened position relative to said carrier element.

16. A junction box as defined in claim 1, wherein said conductor opening is operable to receive a conductor having a diameter of less Than about 0.5 mm.

* * * * *